US008459837B2

(12) United States Patent
Kountotsis

(10) Patent No.: US 8,459,837 B2
(45) Date of Patent: Jun. 11, 2013

(54) LIGHTING APPARATUS HAVING A PLURALITY OF RETRACTABLE MEANS AND METHOD OF MANUFACTURING THE SAME

(76) Inventor: Theodosios Kountotsis, Melville, NY (US)

( * ) Notice: Subject to any disclaimer, the term of this patent is extended or adjusted under 35 U.S.C. 154(b) by 0 days.

(21) Appl. No.: 13/355,503

(22) Filed: Jan. 21, 2012

(65) Prior Publication Data

US 2012/0113627 A1 May 10, 2012

Related U.S. Application Data

(63) Continuation of application No. 12/583,053, filed on Aug. 13, 2009, now Pat. No. 8,132,937.

(51) Int. Cl.
*F21S 4/00* (2006.01)

(52) U.S. Cl.
USPC ..... 362/249.07; 362/249.16; 362/249.09; 362/249.03; 362/249.14

(58) Field of Classification Search
USPC ..... 362/249.03, 249.07, 249.09, 249.16, 362/249.19, 123, 249.14, 249.06, 249.18, 362/653, 654, 647, 285, 288, 418, 419, 430, 362/806
See application file for complete search history.

(56) References Cited

U.S. PATENT DOCUMENTS

| | | | | |
|---|---|---|---|---|
| 3,752,407 | A * | 8/1973 | Baugh et al. | 362/123 |
| 4,516,193 | A * | 5/1985 | Murphy | 362/123 |
| 5,018,055 | A * | 5/1991 | Wu | 362/238 |
| 8,132,937 | B2 * | 3/2012 | Kountotsis | 362/249.07 |
| 8,197,092 | B2 * | 6/2012 | Kountotsis | 362/249.09 |
| 2010/0110668 | A1 * | 5/2010 | Marlonia | 362/152 |
| 2012/0113626 | A1 * | 5/2012 | Kountotsis | 362/184 |

* cited by examiner

*Primary Examiner* — Bao Q Truong
(74) *Attorney, Agent, or Firm* — Theodosios Kountotsis

(57) ABSTRACT

An illuminating device including a plurality of reels each having retractable cords on opposed ends thereof, the plurality of reels located between a plurality of light emitting sources for allowing the light emitting sources to expand and retract with respect to each other, where the plurality of light emitting sources are connected to each other in a series configuration and a retraction mechanism for depressing the plurality of light emitting sources, substantially simultaneously, into a retracted configuration.

24 Claims, 8 Drawing Sheets

LIGHTING APPARATUS HAVING A PLURALITY OF RETRACTABLE MEANS AND METHOD OF MANUFACTURING THE SAME

CROSS-REFERENCE TO RELATED APPLICATIONS

This application is a continuation of U.S. patent application Ser. No. 12/583,053, filed on Aug. 13, 2009, now U.S. Pat. No. 8,132,937 the entire disclosure of which is incorporated by reference herein.

BACKGROUND

1. Field of the Related Art

The present disclosure relates to lighting devices, and more particularly, but not exclusively, to a plurality of lighting members each associated with a plurality of retractable housing members each incorporating several wires for allowing a user to selectively adjust the distance between the plurality of lighting members.

2. Description of the Related Art

Decorative string lights, such as Christmas lights, are generally formed of insulated electrical wire and a plurality of small bulbs. The lengths of the string lights vary, along with the sizes, colors, and number of bulbs on the string. When a set of string lights is applied to a Christmas tree, the string of lights is generally wrapped around the trunk of the tree and along the branches of the tree. Of course, the string of lights may be disposed on any type of structure or product or plant.

When first purchased, the sets of lights generally come in boxes which are not particularly suitable for storing the sets of lights in an orderly fashion thereafter. Since the sets are rather cumbersome to handle (often being eight feet or more in length) they are simply stuffed in boxes or bags for storage. Unfortunately, when the next season arrives these sets of lights are all tangled and in the process of untangling them, generally, several bulbs are broken. Even after the sets of lights have been untangled it is still cumbersome to mount these on a tree because, for example, they are difficult to maneuver around a tree or on a structure, and once placed in an unsatisfactory manner on the tree or structure they must be entirely disassembled to be repositioned in a satisfactory manner.

As a result, if attempting to untangle a webbed mass of improperly stored lights was not daunting enough, the mere act of untangling alone causes undue stress on both the light sockets and light bulbs causing damage to the socket connection and bulb breakage. Furthermore, during reinstallation of the lights, knotting forces one to continually separate the descending strands from the common wire portion that is to be fastened. This causes a substantial waste of time, delays the installation process, and adds to the further frustration of the installer (particularly if the installer is in an elevated position or working upon a ladder or adjusting lights on a structure).

Additionally, it is difficult to maintain a high density degree of the sets of lights on the branches/structure while hiding the excess insulated wire between the bulbs because the wire between the bulbs tends to sag from the branch a/structure, which is not visually pleasing.

Consequently, the tangling of lights, the sagging of wires/lights, and the inability to effectively reposition lights once they are placed on a Christmas tree/or other structure is cumbersome and frustrating. Thus, some new and novel solutions need to be presented that permit the disposition of Christmas lights on a tree or structure for allowing the user to freely maneuver the lights in a variety of directions without the hassles of entanglement and sagging.

SUMMARY

The present disclosure provides a lighting apparatus including at least two lighting members and a retractable housing member having at least two distinct retractable wires slidingly guided therethrough. The retractable housing member is positioned directly between the at least two lighting members to provide operable communication therebetween.

The present disclosure also provides a method for manufacturing a lighting apparatus, including forming at least two lighting members and forming a retractable housing member having at least two distinct retractable wires slidingly guided therethrough. The retractable housing member is positioned directly between the at least two lighting members to provide operable communication therebetween.

The present disclosure also provides an illuminating device, including a plurality of reels each having retractable cords, the plurality of reels located between a plurality of light emitting sources for allowing the light emitting sources to expand and retract with respect to each other.

Further scope of applicability of the present disclosure will become apparent from the detailed description given hereinafter. However, it should be understood that the detailed description and specific examples, while indicating preferred embodiments of the present disclosure, are given by way of illustration only, since various changes and modifications within the spirit and scope of the present disclosure will become apparent to those skilled in the art from this detailed description.

Those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

BRIEF DESCRIPTION OF THE DRAWINGS

Various embodiments of the present disclosure will be described herein below with reference to the figures wherein.

DETAILED DESCRIPTION

Figure 1A:
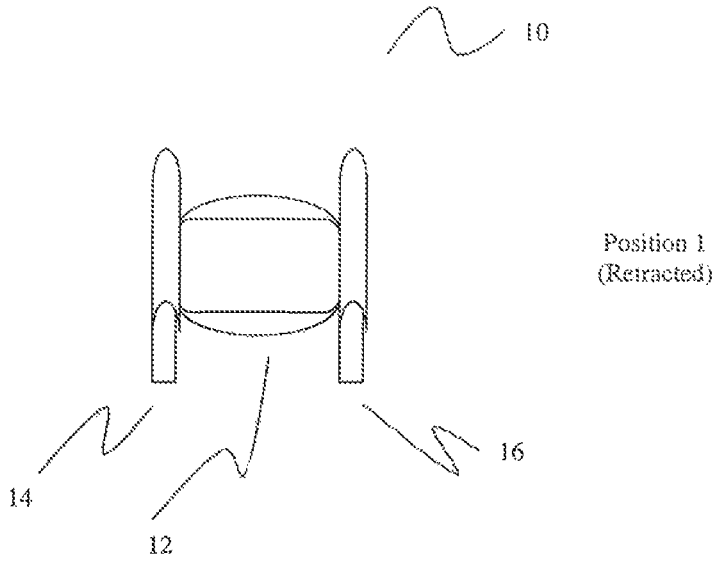
FIG. 1A is a perspective view of a lighting apparatus having two lighting members and a single retractable housing member positioned therebetween in a retracted/depressed position, in accordance with a first exemplary embodiment of the present disclosure.

The illustrations and examples discussed in the following description are provided for the purpose of describing the preferred embodiments of the present disclosure and are not intended to limit the disclosure thereto.

Prior to describing the present disclosure in further detail, it will first be helpful to define various terms that will be used throughout the following discussion. For example:

Unless otherwise indicated, all numbers expressing quantities and conditions, and so forth used in the specification and claims are to be understood as being modified in all instances by the term "about." In this application, the use of the singular includes the plural unless specifically stated otherwise. In this application, the use of "or" means "and/or" unless stated otherwise. Furthermore, the use of the term "including," as well as other forms, such as "includes" and "included," is not limiting. Also, terms such as "element" or "component" encompass both elements and components comprising one unit and elements and components that comprise more than one subunit unless specifically stated otherwise. The term "coupled to" means to be attached or connected directly or indirectly or to be incorporated within.

The term "connect" or "connecting" may refer to adhere, affix, anchor, attach, band, bind, bolt, bond, brace, button, cohere, fasten, couple, embed, establish, fix, grip, hold, hook, implant, link, lock, lodge, screw, seal, rivet, tack on, tighten, or unite. The term "connect" or "connecting" may refer to linking/fastening/attaching/locking any type of materials in a removable/detachable/interchangeable manner.

The present disclosure provides a user a means of precisely locating/positioning or re-locating/re-positioning (moving/shifting/changing/altering/maneuvering) any certain light in its optimum or desired location, independently of the location of other lights in the set of lights, an advantage not readily obtainable with conventional linear, non-flexible strand light sets without great bother and decorating skill.

The present disclosure further provides several advantages, such as: the retractability permits the entire set of lighting members to be easily and conveniently thrust, as an entire assembly, onto the exterior of a tree (or structure) during original installation of the set to the tree (or structure); the retractability of all the lighting members similarly permits ease of removal of the set from the tree (or structure) when the tree is to be taken down after the season is over; the retractability of all the lighting members provides great convenience in many phases of the light storage, handling, distribution, boxing, etc.; the retractability of all the lighting members permits relatively long cords but without the bother and inconvenience of snarling or tangling which is an inherently bothersome and annoying characteristic of conventional linear, non-flexible strand sets; and the retractability permits the individual lighting members to be located at various distances from each other, without leaving unsightly loops or sags in association with conventional lights which are spaced or located at a predetermined distance from each other.

The present disclosure further provides the following advantages: the lighting members expand with respect to each other via the retractable cords, thereby allowing for easy placement of the components/elements around a Christmas tree (or structure) base and branches (or any other structure). The amount of time associated with decorating a Christmas tree (or structure) with prior art decorative string lights is dramatically reduced by using the fighting members/structure/mechanism/configuration of the present disclosure. The retractable cord design of the present disclosure prevents sagging associated with prior art string lights. The design also helps to prevent sagging of the connecting plugs when lighting members are connected to one another. Unlike prior art decorative light strings, the lighting members/structure/mechanism/configuration of the present disclosure are easily disassembled. Specifically, the lighting members/structure/mechanism/configuration automatically returns to its compressed length and is then available for quick storage. As mentioned above, there is no concern over the cords tangling during storage or with tediously winding the cord around, for example, an oscillating storage rack.

The present disclosure further provides a lighting system or structure or mechanism or configuration (e.g., for Christmas trees) which is readily adapted to a variety of tree sizes including different tree trunk lengths and different numbers of limbs. The present disclosure further provides a lighting system or apparatus or arrangement which is susceptible of a low cost of manufacture with regard to both materials and labor, and which accordingly is then susceptible of low prices of sale to the consuming public, thereby making such Christmas tree light ring arrangements economically available to the buying public. Of course, the lighting members of the present disclosure need not be used only as Christmas decorations. The lighting members having retractable cord capabilities may be used in a variety of commercial and non-commercial applications, such as in homes, dorm rooms, etc. Such structures are discussed in detail further below.

Reference will now be made in detail to embodiments of the present disclosure. While certain embodiments of the present disclosure will be described, it will be understood that it is not intended to limit the embodiments of the present disclosure to those described embodiments. To the contrary, reference to embodiments of the present disclosure is intended to cover alternatives, modifications, and equivalents as may be included within the spirit and scope of the embodiments of the present disclosure as defined by the appended claims.

Embodiments will be described below while referencing the accompanying figures. The accompanying figures are merely examples and are not intended to limit the scope of the present disclosure.

With reference to FIG. 1A, there is presented a perspective view of a lighting apparatus having two lighting members and a single retractable housing member positioned therebetween in a retracted/depressed position, in accordance with a first exemplary embodiment of the present disclosure.

The lighting apparatus 10 of FIG. 1A includes a retractable housing member 12, a first lighting member 14, and a second lighting member 16. The first lighting member 14 and the second lighting member 16 each abut the retractable housing member 12 in a retracted/depressed first position. In other words, in a first exemplary embodiment, the retractable housing member 12 is positioned directly between the first lighting member 14 and the second lighting member 16 for providing operable communication therebetween.

Figure 3A:
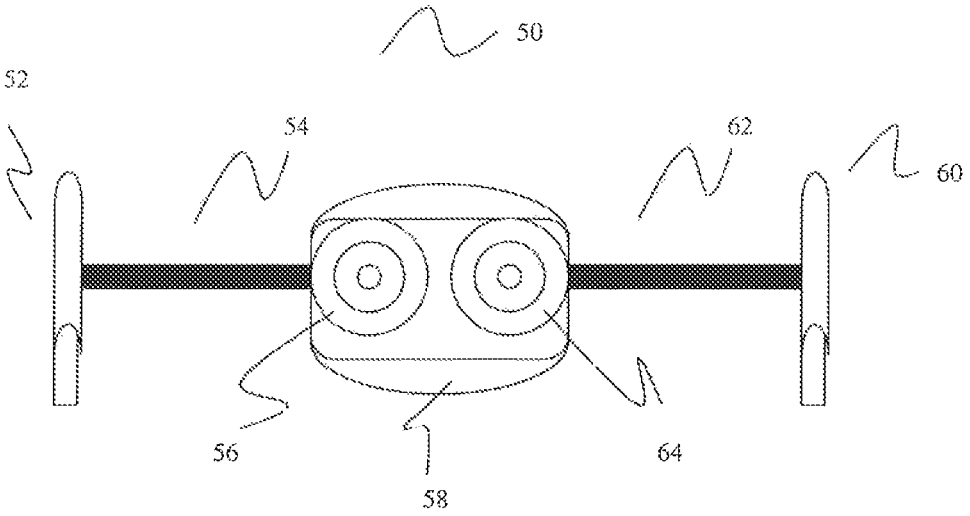
FIG. 3A is a perspective view of a lighting apparatus having a retractable housing member with two reels therein for managing wires connected to the lighting members, in accordance with a first exemplary embodiment of the present disclosure.
Figure 3B:
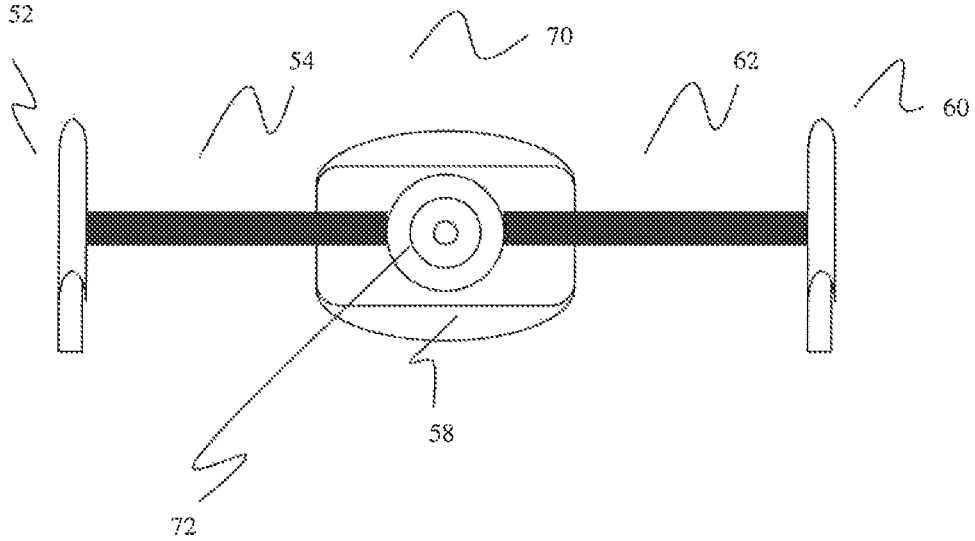
FIG. 3B is a perspective view of a lighting apparatus having a retractable housing member with one reel therein for managing wires connected to the lighting members, in accordance with a first exemplary embodiment of the present disclosure.

The retractable housing member 12 may include one or more reels for holding one or more wires slidably guided therethrough (see FIGS. 3A and 3B). The retractable housing member 12 may be any shape or size, and may be constructed by any type of material.

The first lighting member 14 and the second lighting member 16 may be any type of lighting device/apparatus/system. For example, the lighting members 14, 16 may be a light bulb, a light emitting diode (LED), etc. The lighting members 14, 16 may be any shape or size, and may be constructed by any type of material.

Figure 1B:
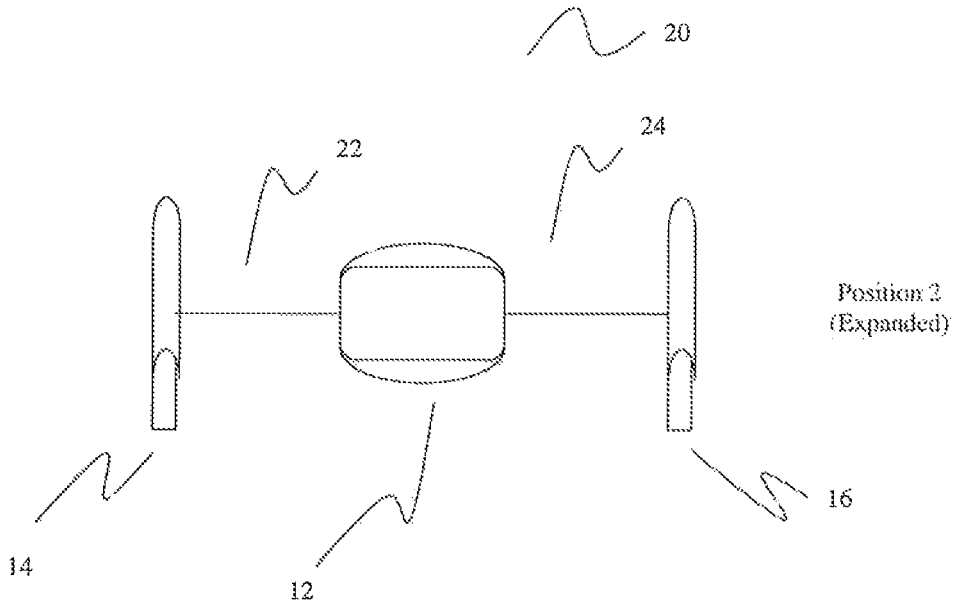
FIG. 1B is a perspective view of a lighting apparatus having two lighting members and a single retractable housing member positioned therebetween in an expanded position, in accordance with a first exemplary embodiment of the present disclosure.

With reference to FIG. 1B, there is presented a perspective view of a lighting apparatus having two lighting members and a single retractable housing member positioned therebetween in an expanded position, in accordance with a first exemplary embodiment of the present disclosure.

The lighting apparatus 20 of FIG. 1B includes a retractable housing member 12, a first lighting member 14, a second lighting member 16, a first wire 22, and a second wire 24. The first lighting member 14 and the second lighting member 16 are extended outwardly exposing first wire 22 and second wire 24 from the retractable housing member 12 in an expanded second position. The first lighting member 14 and the second lighting member 16 remain fixedly secured in the expanded position.

The first lighting member 14 and the second lighting member 16 may be manufactured to be extended by a few millimeters to about a few feet from the retractable housing member 12 depending on the design and application desired. One skilled in the art may envision a plurality of different designs and applications where the lighting members and the retractable cords are of a varying length, width, shape, size, etc.

Once the first lighting member 14 and the second lighting member 16 are extended outwardly in an expanded manner, the first lighting member 14 and the second lighting member 16 remain in that expanded position until another force is applied to each wire 22, 24. Thus, the lighting members 14, 16 may be repositioned/adjusted/maneuvered independently of each other.

The first wire 22 and the second wire 24 may be any type of wire made from any type of material and of any type of length. The first wire 22 and the second wire 24 may be incorporated within the retractable housing member 12 and may be connected to one or more reels (see FIGS. 3A and 3B).

Figure 2A:
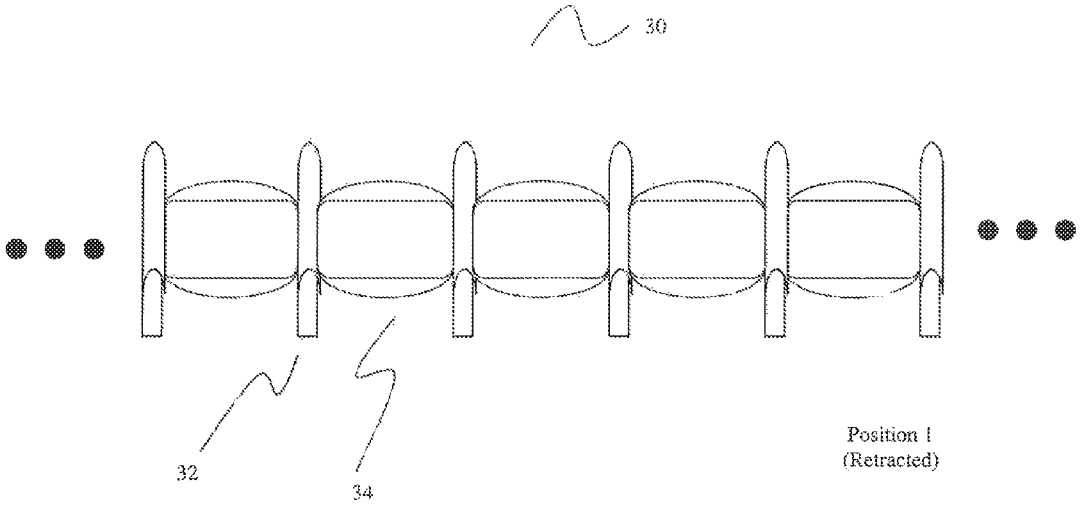
FIG. 2A is a perspective view of a lighting apparatus having a plurality of lighting members and a plurality of retractable housing members positioned therebetween in a retracted/depressed position, in accordance with a first exemplary embodiment of the present disclosure.

With reference to FIG. 2A, there is presented a perspective view of a lighting apparatus having a plurality of lighting members and a plurality of retractable housing members positioned therebetween in a retracted/depressed position, in accordance with a first exemplary embodiment of the present disclosure.

The lighting apparatus 30 of FIG. 2A includes a plurality of lighting members 32 and a plurality of retractable housing members 34. Each of the plurality of lighting members 32 abut a retractable housing member of the plurality of housing members 34 in a retracted/depressed first position.

The lighting apparatus 30 may be packaged or manufactured or sold in a retracted/depressed first position.

The length of the lighting apparatus 30 may be any desirable length, from a few feet to a few hundred feet to a few thousand feet. One skilled in the art may envision a plurality of different designs and applications where the lighting members and the retractable cords are of a varying length, width, shape, size, etc.

Figure 2B:
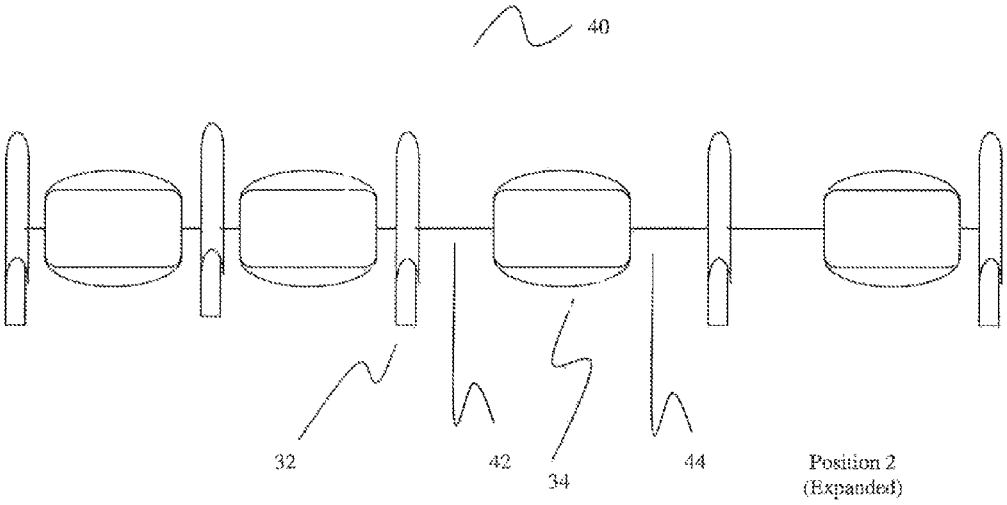
FIG. 2B is a perspective view of a lighting apparatus having a plurality of lighting members and a plurality of retractable housing members positioned therebetween in an expanded position, in accordance with a first exemplary embodiment of the present disclosure.

With reference to FIG. 2B, there is presented a perspective view of a lighting apparatus having a plurality of lighting members and a plurality of retractable housing members positioned therebetween in an expanded position, in accordance with a first exemplary embodiment of the present disclosure.

The lighting apparatus 40 of FIG. 2B includes a plurality of lighting members 32, a plurality of retractable housing members 34, a plurality of first wires 42, and a plurality of second wires 44. Each of the plurality of lighting members 32 extends outwardly from its respective retractable housing member in an expanded second position. Once a force is applied to each individual lighting member 32, the lighting member 32 remains in that expanded position until a further force is applied for repositioning purposes.

The first lighting member 14 and the second lighting member 16 may be manufactured to be extended by a few millimeters to about a few feet from the retractable housing member 12 depending on the design and application desired.

Thus, by applying retraction-actuation movement to each lighting member 32, by depressing an associated plunger mechanism (not shown), a retraction spring (not shown) within the retractable housing member 34 may cause tension to exist in the wires 42, 44, that is, between the retractable housing member 34 and that lighting member 32, to cause the lighting member 32 to be retracted into the compact cluster until again it is desired to withdraw that lighting member 32 for re-positioning in a selective manner. In other words, forces may be applied to any of the lighting members 32 individually, to selectively re-position such lighting member 32 by any distance desired with respect to its retractable housing member 34.

As illustrated in FIG. 2B, the distance between the lighting members 32 may vary from lighting member to lighting member. In other words, the distance between a first lighting member and a second lighting member (which are adjacent when depressed) may be the same or may be different. Additionally, the distance between a first lighting member and a retractable housing member may be different than the adjacent second lighting member and the same retractable housing member. For instance, a retractable housing member 34 has two lighting members 32 abutting it, one on each side. The first lighting member 32 may be expanded/stretched to a distance of 1 inch, whereas the second lighting 32 member may be expanded/stretched to a distance of 3 inches. In other words, the lighting members 32 attached to the same retractable housing member 34 may be expanded/stretched by unequal distances. This concept is clearly illustrated in FIG. 2B where certain lighting members 32 are expanded/stretched at different distances (selectively re-positioned based on a number of criteria) with respect to their retractable housing members 34.

Moreover, the lighting members 32 may be energized via a power source (see FIG. 4) whether they are in a depressed position or in an expanded position. In other words, if electrical power is supplied to the lighting members 32 while in a retracted state (see Ha 2A), all the lighting members 32 may be illuminated. Additionally, if electrical power is supplied to the lighting members 32 while in an expanded state (see FIG. 2B), all the lighting members may be illuminated. Once positioned on a tree or structure, the lighting members 32 may be repositioned while energized or power is supplied to them. This enables a user great flexibility and freedom in maneuvering the illuminated lighting members 32 while lit in order to determine the best positioning.

With reference to FIG. 3A, there is presented a perspective view of a lighting apparatus having a retractable housing member with two reels therein for managing wires connected to the lighting members, in accordance with a first exemplary embodiment of the present disclosure.

The lighting apparatus 50 of FIG. 3A includes a first lighting member 52, a first wire 54, a first reel 56, a retractable housing member 58, a second lighting apparatus 60, a second wire 62, and a second reel 64. In this configuration, each lighting member 52, 60 includes a separate and distinct wire 54, 62, respectively, where each wire 54, 62 is linked/connected to/in association with a separate and distinct reel 56, 64 respectively.

A reel 56, 64 typically comprises a cylindrical reel drum onto which a flexible linear material (such as cord, hose, etc.) is spooled. The drum ordinarily rotates about a central axis to wind or unwind (also referred to herein as spooling and unspooling) the linear material with respect to the cylindrical drum surface. Some reels include housings that protect the drum and spooled linear material from the environment. The housing may include an opening or aperture through which the linear material extends, so that it may be pulled from the housing and subsequently retracted back into the housing. A variety of electrical cord reels include spring return mechanisms for automatically spooling the linear material. Typically, a coil of flat spring steel stock is provided with one end secured to the reel drum and the other end secured to a spindle on which the drum rotates.

With reference to FIG. 3B, there is presented a perspective view of a lighting apparatus having a retractable housing member with one reel therein for managing wires connected to the lighting members, in accordance with a first exemplary embodiment of the present disclosure.

The lighting apparatus 70 of FIG. 3B includes a first lighting member 52, a first wire 54, a retractable housing member 58, a second lighting apparatus 60, a second wire 62, and a single reel 72. In this configuration, each lighting member 52, 60 includes a separate and distinct wire 54, 62, respectively, where each wire 54, 62 is linked/connected to/in association with a single reel 72.

Figure 4:
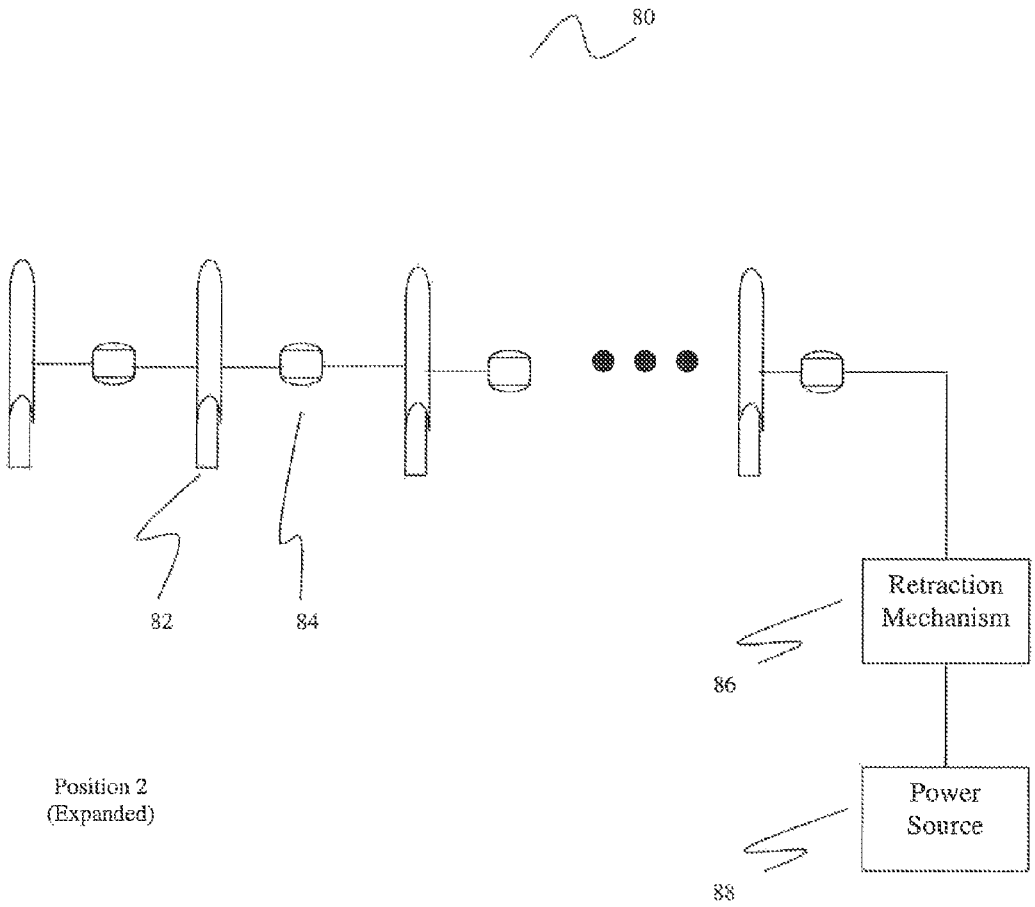
FIG. 4 is a perspective view of a lighting apparatus having a plurality of lighting members and a plurality of retractable housing members positioned therebetween in an expanded position, and connected to a retraction mechanism and a power source, in accordance with a first exemplary embodiment of the present disclosure.

With reference to FIG. 4, there is presented a perspective view of a lighting apparatus having a plurality of lighting members and a plurality of retractable housing members positioned therebetween in an expanded position, and connected to a retraction mechanism and a power source, in accordance with a first exemplary embodiment of the present disclosure.

The lighting apparatus 80 of FIG. 4 includes a plurality of lighting members 82, a plurality of retractable housing members 84, a retraction mechanism 86, and a power source 88.

The retraction mechanism 86 permits the user to press a button to quickly depress/retract the length of the wire(s) connecting the plurality of lighting members 82 in a manual or automatic manner. In other words, once the user removes the lighting apparatus 80 from a tree or other structure, the user need not go through each of the plurality of lighting members 82 to retract each one individually into its initial depressed/retracted position. The user may press a button and have all the wires of the plurality of retractable housing members 84 to be reinserted automatically within the casing of the plurality of retractable housing members 84. Thus, the retraction mechanism 86 allows for all the lighting members 82 to be automatically and simultaneously returned to their compressed length (depressed/retracted position) and, therefore, available for storage in a compressed state (which is the easiest for storage).

The power source 88 may be any type of power source suitable for providing power to an electronic device, such as batteries, wall outlet, solar energy, hybrid sources, etc. Electronic devices require power in the form of voltages and currents to operate. Different electronic systems may require a wide variety of power sources with different voltages and currents to operate. For example, some systems may operate of AC voltages and currents and others may require DC voltages and currents. For AC powered systems, the voltages and currents of the power source must be in some specified range (e.g., 110V AC or 220V AC). Similarly, DC powered systems may require that the DC voltage and DC currents supplied by the power source meet certain ratings (e.g., 5 volts and 500 mA). The power source 88 may be a portable power source or a non-portable power source. The power source 88 may wirelessly transmit power to the lighting apparatus 80.

Figure 5:
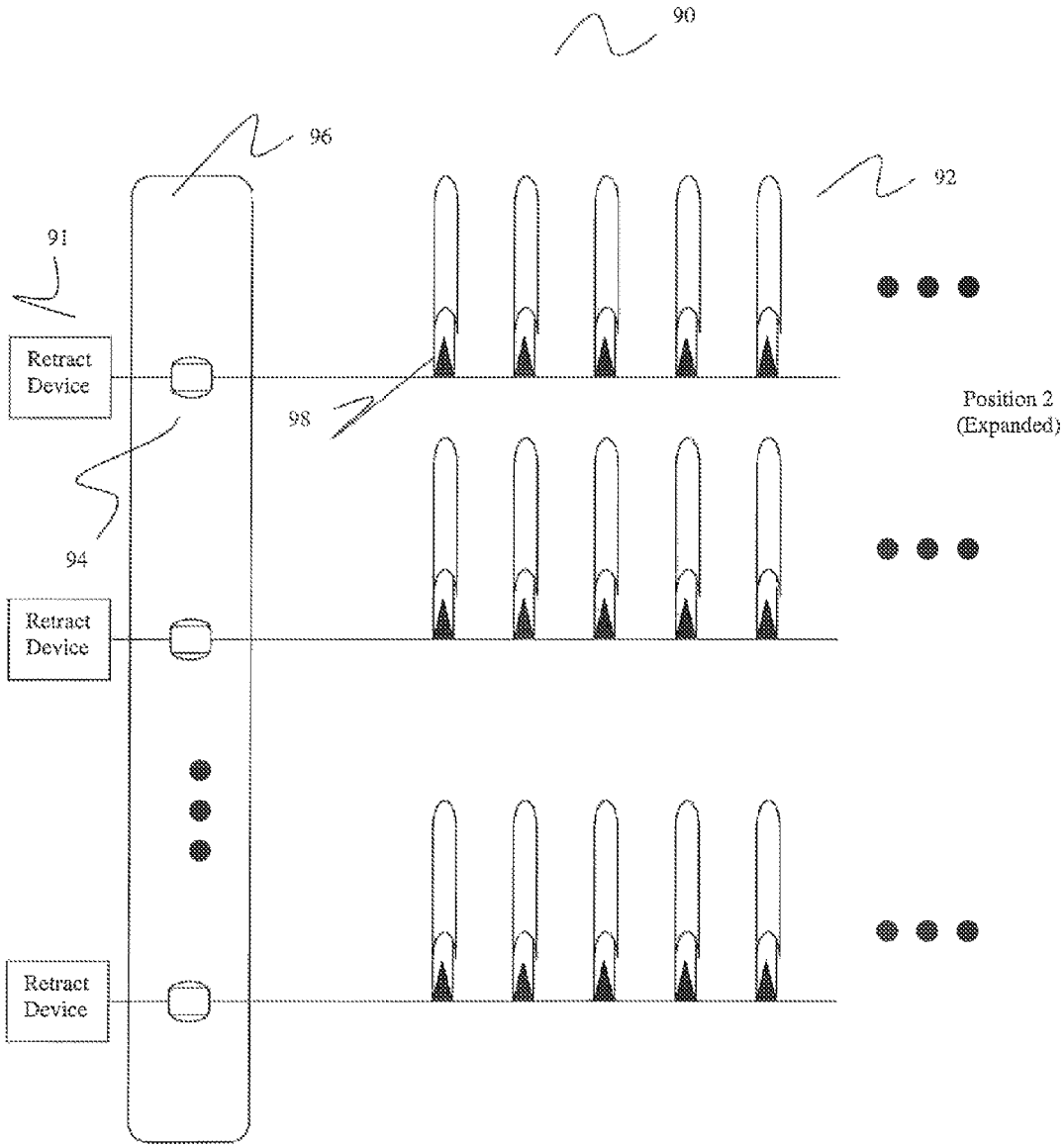
FIG. 5 is a perspective view of a lighting apparatus having a plurality of lighting members and a plurality of retractable housing members where a set of the plurality of lighting members are connected to a single retractable housing member to form a linear linkage configuration, in accordance with a second exemplary embodiment of the present disclosure.

With reference to FIG. 5, there is presented a perspective view of a lighting apparatus having a plurality of lighting members and a plurality of retractable housing members where a set of the plurality of lighting members are connected to a single retractable housing member to form a linear linkage configuration, in accordance with a second exemplary embodiment of the present disclosure.

The lighting apparatus 90 of FIG. 5 includes a plurality of lighting members 92, a plurality of retractable housing members 94, a connecting member 96, a linkage mechanism 98, and a plurality of retract devices 91.

The connecting member 96 may be a strap or housing for incorporating the plurality of retractable housing members 94. Each of the plurality of retractable housing members 94 may be connected to a single string/wire having a plurality of lighting members 92. The connecting member 96 may allow the connection of a plurality of lighting members 92 in a linear manner via a plurality of retractable housing members 94.

The linkage mechanism 98 is a structure or component that allows the plurality of lighting members 92 to be connected/attached/linked to each other in a linear fashion to a single retractable housing member 94. The detailed construction/operation/functionality of the linkage mechanism 98 is described below with reference to FIGS. 6A and 6B.

In operational use, the parallel light strings having the plurality of lighting members 92 may be disposed generally vertically downward on, for example, a Christmas tree or a housing structure. In other words, a strap or housing incorporating the plurality of retractable housing members 94 may be positioned or located On an interior wall, an exterior wall, and/or a top portion of a Christmas tree, where a plurality of strings each having a plurality of lighting members 92 is vertically (or even horizontally) disposed or arranged or organized.

Figure 6A:
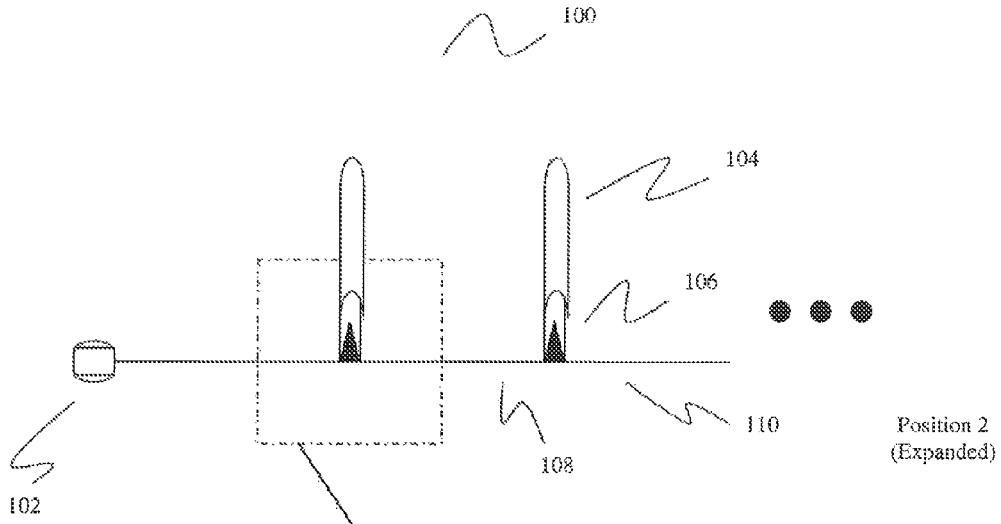
FIG. 6A is a perspective view of a lighting apparatus having a plurality of lighting members and a single retractable housing member illustrating how a wire connects the plurality of lighting members, in accordance with a second exemplary embodiment of the present disclosure.

With reference to FIG. 6A, there is presented a perspective view of a lighting apparatus having a plurality of lighting members and a single retractable housing member illustrating how a wire connects the plurality of lighting members, in accordance with a second exemplary embodiment of the present disclosure.

The lighting apparatus 100 of FIG. 6A includes a retractable housing member 102, a plurality of lighting members 104, a linkage mechanism 106, a first side of wire 108, and a second side of wire 110.

FIG. 6A merely illustrates a portion of the lighting apparatus 90.

Figure 6B:
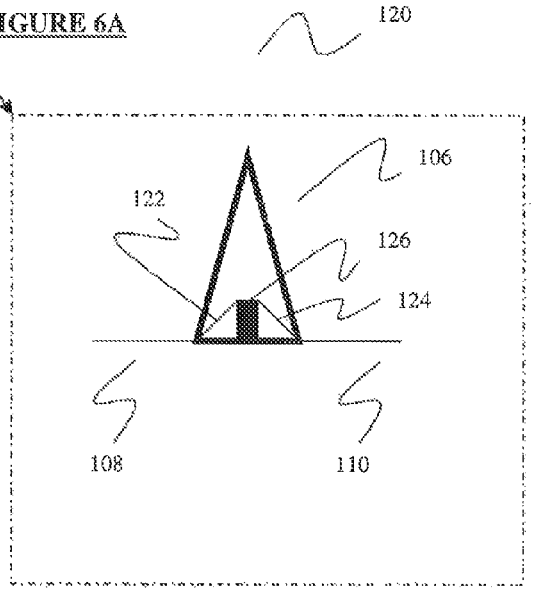
FIG. 6B is an expanded view of the wire connection of FIG. 6A, in accordance with the second exemplary embodiment of the present disclosure.

With reference to FIG. 6B, there is presented an expanded view of the wire connection of FIG. 6A, in accordance with the second exemplary embodiment of the present disclosure.

The lighting apparatus 120 of FIG. 6B includes a retractable housing member 102, a plurality of lighting members 104, a linkage mechanism 106, a first side of wire 108, and a second side of wire 110 as shown in FIG. 6A. However, the lighting apparatus 120 also includes a coupling member 126 positioned between the first section of wire 122 and a second section of wire 124.

In accordance with FIGS. 6A and 6B, the retractable housing member 102 connects the plurality of lighting members 104 via one single wire. However, the wire travels or is guided through the interior portion of each of the plurality of lighting members 104, where each of the plurality of lighting members 104 includes a coupling member 126 for redirecting the first side of wire 108 and the second side of the wire 110 through each of the plurality of lighting members 104. The distance of the wire between the plurality of lighting members 104 is dependent on the length of the wire. Thus, the plurality of lighting members 104 move/shift/maneuver on a single wire (108, 122, 124, 110) and the distance between the plurality of lighting members 104 is dependent on each adjacent lighting member and the length of the wire.

Figure 7A:
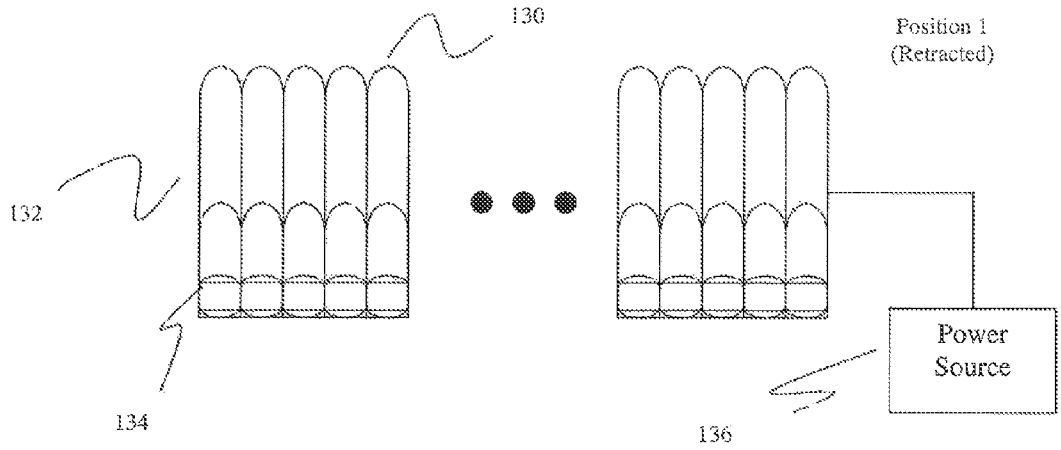
FIG. 7A is a perspective view of a plurality of lighting members and a plurality of retractable housing members in a depressed/retracted state, where the retractable housing members are incorporated within the plurality of lighting members, in accordance with a third exemplary embodiment of the present disclosure.

With reference to FIG. 7A, there is presented a perspective view of a plurality of lighting members and a plurality of retractable housing members in a depressed/retracted state, where the retractable housing members are incorporated within the plurality of lighting members, in accordance with a third exemplary embodiment of the present disclosure.

The lighting apparatus 130 of FIG. 7A includes a plurality of lighting members 132, a plurality of retractable housing members 134 in a retracted position, and a power source 136.

The lighting apparatus 130 is shown in a depressed/retracted position. Each of the plurality of retractable housing members 134 are incorporated within the plurality of lighting members 132. Thus, it is contemplated that each lighting member 132 incorporates, fully or partially, a retractable housing member 134. The retractable housing member 134 may be positioned on the top portion, the bottom portion or a middle portion of the lighting member 132 and may or may not be visible to a user of the plurality of lighting members 132.

Figure 7B:
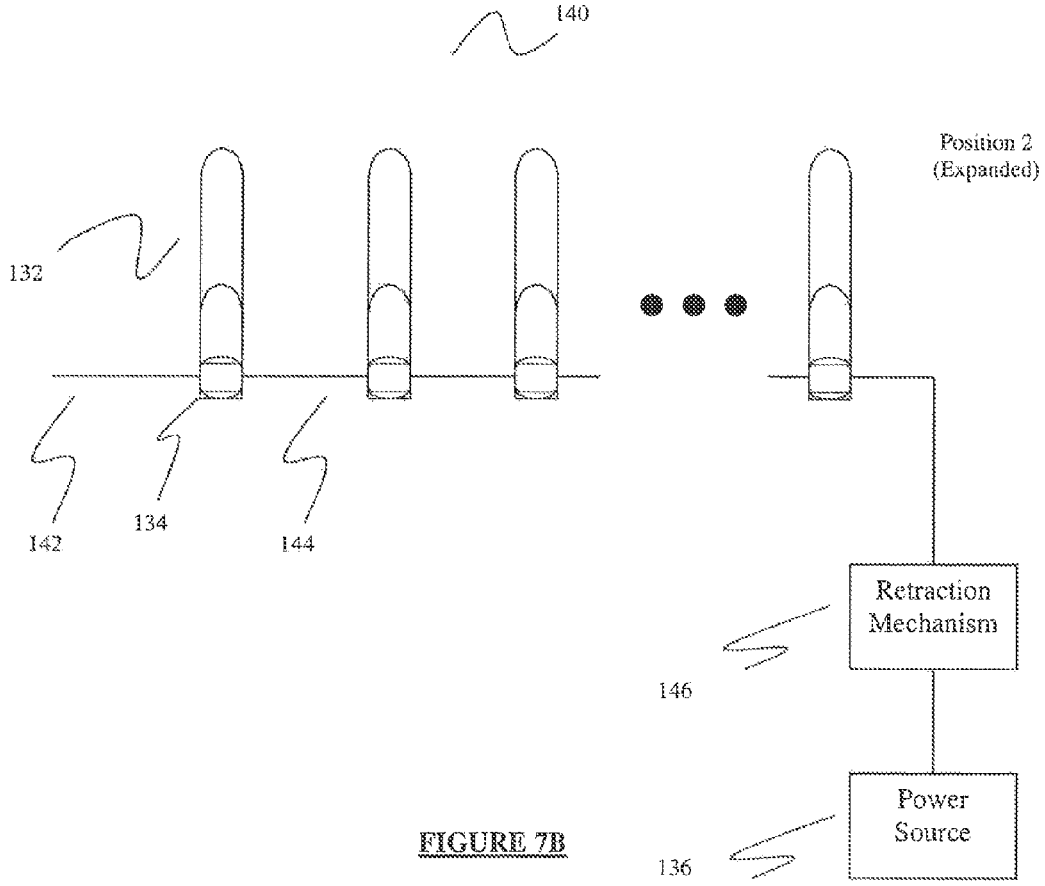
FIG. 7B is a perspective view of a plurality of lighting members and a plurality of retractable housing members in an expanded state, where the retractable housing members are incorporated within the plurality of lighting members, in accordance with a third exemplary embodiment of the present disclosure.

With reference to FIG. 7B, there is presented a perspective view of a plurality of lighting members and a plurality of retractable housing members in an expanded state, where the retractable housing members are incorporated within the plurality of lighting members, in accordance with a third exemplary embodiment of the present disclosure.

The lighting apparatus 140 of FIG. 7B includes a plurality of lighting members 132, a plurality of retractable housing members 134 in an expanded position, a power source 136, a first section of wire 142, a second section of wire 144, and a retraction mechanism 146.

The lighting apparatus 140 is shown in an expanded/stretched position. As illustrated, each retractable housing member 134 remains within its respective lighting member 132 as the system/mechanism/configuration moves from a first position (depressed) to a second position (expanded). Of course, the plurality of lighting members 132 are energized by a power source 136 and may also include a retraction mechanism 146 for controlling/manipulating/forcing/pulling/managing the plurality of lighting members 132.

Figure 8:
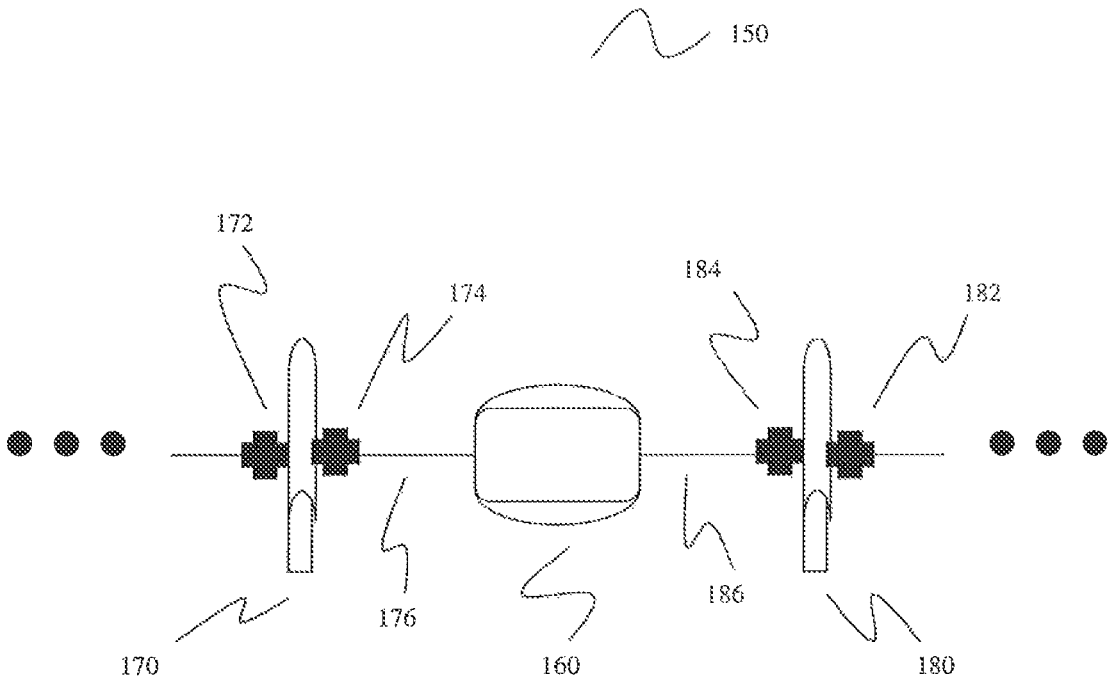
FIG. 8 is a perspective view of a lighting apparatus having two lighting members and a single retractable housing member positioned therebetween in an expanded position, where each of the lighting members is detachably mounted on the retractable housing member, in accordance with a fourth embodiment of the present disclosure.

With reference to FIG. 8, there is presented a perspective view of a lighting apparatus having two lighting members and a single retractable housing member positioned therebetween in an expanded position, where each of the lighting members is detachably mounted on the retractable housing member, in accordance with a fourth embodiment of the present disclosure.

The lighting apparatus 150 of FIG. 8 includes a retractable housing member 160, a first lighting member 170 having a first detachable mechanism 172 and a second detachable mechanism 174. The lighting apparatus 150 further includes a second lighting member 180 having a third detachable mechanism 182 and a fourth detachable mechanism 184. The retractable housing member 160 is connected to the first lighting member 170 and the second lighting member 180 via a first wire 176 and a second wire 186.

In accordance with another exemplary embodiment, each lighting member 170, 180 may include detachable mechanisms 172, 174, 182, 184 for connecting or disconnecting one or more lighting members 170, 180 to one or more sets of lighting members. In other words, if a lighting member burns out, the user may detach that burned out lighting member and attach a working lighting member. Any type of mechanism may be used to detach and attach individual (or sets of) lighting members from the cadre set of lighting members 170, 180. The detachable mechanisms 172, 174, 182, 184 may be positioned on both sides of each of the lighting members 170, 180. Of course, the detachable mechanisms 172, 174, 182, 184 may be positioned on any surface of the lighting members 170, 180 (e.g., the bottom portion of the lighting members 170, 180). The detachable mechanisms 172, 174, 182, 184 may be slidable mechanisms that permit the wires to slide in and out of a portion of the lighting members. Of course, one skilled in the art may contemplate a number of connection mechanisms, such as a snap mechanism, a lock mechanism, threaded mechanisms, etc. The detachable mechanisms 172, 174, 182, 184 may be positioned on the outer surface of the lighting members 170, 180 or may be incorporated on an inner portion of the lighting members 170, 180 (fully or partially).

Optionally, it is contemplated that several of the lighting members described herein are directly connected to each other via a non-flexible wire. In other words, there may be separate and distinct sets of non-flexible lighting members that are connected to each other via a retractable housing member. Thus, it is not necessary to position a retractable housing member between each and every lighting member, even though that may be preferred for certain applications. Thus, it is also not necessary to position a retractable housing member within each and every lighting member. One skilled in the art may contemplate several lighting configurations where a retractable housing member may or may not be necessary (for the entire sting of lighting members) or where one or more retractable housing members connect lighting members with or without flexible wires therebetween. One skilled in the art may also contemplate using such features in a variety of combinations without departing from the scope of the present disclosure.

The various electrical leads, conductors, and plugs forming the apparatus of the present disclosure including the distribution bands, the branch circuits, and the extension cord are formed of suitable flexible electrical conductors and insulation materials well known to those skilled in the art. The light sockets and the lights are selected from various available sizes and designs. The particular bulbs and sockets may range from the very small miniature sizes available to largo outdoor all weather designs.

Additionally, all the lighting members of the present disclosure are not limited to any particular shape or design. Although the lighting members are described and depicted herein as being of generally cylindrical upstanding form, the configurations of the lighting members is a matter of design choice. While opaque, single-thickness materials may be preferred for use, transparent or plural-layer materials may be used, if desired, to enhance visibility, to provide added insulating capability, or for other purposes.

It will be understood that there are to be no limitations as to the dimensions and shape of the lighting members or the materials from which the lighting members are manufactured or the electronics/power systems that may be used to power the lighting members. The lighting members may be constructed to resemble any commercially available design for illuminating light and may be manufactured from any suitable plastic, glass or metal material.

Moreover, certain modifications and improvements will occur to those skilled in the art upon a reading of the foregoing description. For example, the lighting members of the present disclosure are not limited to application on Christmas trees or indoor use. Rather, the lighting members may be applied in several ways used in a variety of applications, such as on stair rails, wreaths, garland, lamp posts, mail boxes, shrubbery, columns, porch railings, homes, commercial structures, etc. For example, the exemplary embodiments of the present disclosure may be used for indoor reading lights, floor lamps, table lamps, ceiling lights, lamps, or any type of indoor, outdoor, commercial, or non-commercial illuminating means. All such modifications and improvements of the present disclosure have not been described herein for the sake of conciseness and readability but are properly within the scope of the following claims.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Having described the present disclosure above, various modifications of the techniques, procedures, material and equipment will be apparent to those in the art. It is intended that all such variations within the scope and spirit of the appended claims be embraced thereby.

The foregoing examples illustrate various aspects of the present disclosure and practice of the methods of the present disclosure. The examples are not intended to provide an exhaustive description of the many different embodiments of the present disclosure. Thus, although the foregoing disclosure has been described in some detail by way of illustration and example for purposes of clarity and understanding, those of ordinary skill in the art will realize readily that many changes and modifications may be made thereto without departing form the spirit or scope of the present disclosure. Hence, the proper scope of the present disclosure should be determined only by the broadest interpretation of the appended claims so as encompass all such modifications as well as all relationships equivalent to those illustrated in the drawings and described in the specification.

With respect to the above description then, it is to be realized that the optimum dimensional relationships for the parts of the present disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A lighting mechanism, comprising:

a plurality of lighting members configured to be connected to each other in a series configuration; and a plurality of retractable housing members each configured to include retractable wires on opposed ends thereof and at least one retractable housing member of the plurality of retractable housing members incorporated within each of the plurality of lighting members;

wherein the plurality of lighting members are adapted to be selectively repositioned with respect to each other via displacement of the opposed retractable wires of each of the plurality of retractable housing members incorporated therein.

2. The lighting mechanism according to claim 1, wherein each of the plurality of lighting members are expanded in equal distances with respect to each other.

3. The lighting mechanism according to claim 1, wherein each of the plurality of lighting members are expanded in unequal distances with respect to each other.

4. The lighting mechanism according to claim 1, wherein at least one lighting member of the plurality of lighting members is independently adjusted with respect to the other lighting members.

5. The lighting mechanism according to claim 1, wherein when a force is applied to one lighting member of the plurality of lighting members, the one lighting member extends outwardly, thus exposing a wire of the retractable wires of the at least one retractable housing member incorporated therein; and wherein the one lighting member remains fixedly secured in an expanded position.

6. The lighting mechanism according to claim 1, wherein each of the plurality of retractable housing members includes at least one retractable reel therein.

7. The lighting mechanism according to claim 1, wherein the plurality of lighting members are energized via a power source whether in an expanded or depressed position.

8. The lighting mechanism according to claim 1, wherein when forces are applied to one or more of the plurality of lighting members, the plurality of lighting members remain in a fixedly secured expanded position without causing tension between the plurality of lighting members and the plurality of retractable housing members so as to prevent sagging of a plurality of wires.

9. The lighting mechanism according to claim 1, wherein the plurality of lighting members are a plurality of Christmas lights.

10. The lighting mechanism according to claim 1, further comprising a release mechanism for depressing the plurality of lighting members, substantially simultaneously, into a retracted configuration.

11. The lighting mechanism according to claim 1, further comprising a release mechanism for automatically retracting all of the retractable wires of each of the plurality of retractable housing members to compress the plurality of lighting members into a compressed state.

12. A lighting mechanism, comprising:

a plurality of lighting members configured to be connected to each other in a series configuration;

a plurality of retractable housing members each configured to include retractable wires on opposed ends thereof and at least one retractable housing member of the plurality of retractable housing members incorporated within each of the plurality of lighting members; and a release mechanism for depressing the plurality of lighting members, substantially simultaneously, into a retracted configuration.

13. The lighting mechanism according to claim 12, wherein each of the plurality of lighting members are expanded in equal distances with respect to each other.

14. The lighting mechanism according to claim 12, wherein each of the plurality of lighting members are expanded in unequal distances with respect to each other.

15. The lighting mechanism according to claim 12, wherein at least one lighting member of the plurality of lighting members is independently adjusted with respect to the other lighting members.

16. The lighting mechanism according to claim 12, wherein when a force is applied to one lighting member of the plurality of lighting members, the one lighting member extends outwardly, thus exposing a wire of the retractable wires of the at least one retractable housing member incorporated therein; and wherein the one lighting member remains fixedly secured in an expanded position.

17. The lighting mechanism according to claim 12, wherein each of the plurality of retractable housing members includes at least one retractable reel therein.

18. The lighting mechanism according to claim 12, wherein the plurality of lighting members are energized via a power source whether in an expanded or depressed position.

19. The lighting mechanism according to claim 12, wherein when forces are applied to one or more of the plurality of lighting members, the plurality of lighting members remain in a fixedly secured expanded position without causing tension between the plurality of lighting members and the plurality of retractable housing members so as to prevent sagging of a plurality of wires.

20. The lighting mechanism according to claim 12, wherein the plurality of lighting members are a plurality of Christmas lights.

21. The lighting mechanism according to claim 12, wherein, in the retracted configuration, all of the retractable wires of each of the plurality of retractable housing members are inserted therein, such that the plurality of lighting members are in a compressed state.

22. An illuminating device, comprising:

a plurality of reels each having retractable cords on opposed ends thereof, the plurality of reels located between a plurality of light emitting sources for allowing the light emitting sources to expand and retract with respect to each other, where the plurality of light emitting sources are connected to each other in a series configuration; and a retraction mechanism for depressing the plurality of light emitting sources, substantially simultaneously, into a retracted configuration.

23. The illuminating device according to claim 22, wherein in the retracted configuration, the retractable cords of each of the plurality of reels are inserted therein, such that the plurality of light emitting sources are in a compressed state.

24. The illuminating device according to claim 22, wherein at least one light emitting source of the plurality of light emitting sources is independently adjusted with respect to the other light emitting sources.

* * * * *